United States Patent [19]

Hoffmann

[11] 4,454,079

[45] Jun. 12, 1984

[54] CIRCULAR COOLING TOWER WITH IMPROVED FILL SUPPORTING STRUCTURE AND PROCESS OF FORMING

[75] Inventor: Paul D. Hoffmann, Des Peres, Mo.

[73] Assignee: Lilie-Hoffmann Cooling Towers, Inc., St. Louis, Mo.

[21] Appl. No.: 394,525

[22] Filed: Jul. 2, 1982

[51] Int. Cl.[3] ..... B01F 3/04

[52] U.S. Cl. ..... 261/111; 52/245; 52/741; 261/DIG. 11

[58] Field of Search ..... 261/111, 112, DIG. 11, 261/DIG. 77, DIG. 85, DIG. 86; 52/245, 637, 638, 745, 741; 165/DIG. 1

[56] References Cited

U.S. PATENT DOCUMENTS

| | | | |
|---|---|---|---|
| 3,395,902 | 8/1968 | Spalding et al. | 261/DIG. 11 |
| 3,608,873 | 9/1971 | Furlong | 261/DIG. 11 |
| 3,628,776 | 12/1971 | Raseley | 261/DIG. 11 |
| 3,870,773 | 3/1975 | Luzaich | 261/DIG. 11 |
| 4,032,604 | 6/1977 | Parkinson et al. | 261/DIG. 11 |
| 4,129,625 | 12/1978 | Fordyce et al. | 261/DIG. 11 |
| 4,282,696 | 8/1981 | Michel | 261/DIG. 11 |
| 4,299,785 | 11/1981 | Fougea | 261/DIG. 11 |

*Primary Examiner*—Richard L. Chiesa

*Attorney, Agent, or Firm*—Gravely, Lieder & Woodruff

[57] ABSTRACT

A cooling tower has a circular cooling section, the top of which is a hot water distribution basin to which hot water is pumped while the bottom is a collecting basin. Within the cooling section is a fill comprised of a multitude of slats and wire grids through which the slats project so that the slats are carried by wire grids. The grids in turn are supported at several levels on a framework that rests on the collecting basin and extends upwardly to the distribution basin, but the framework is not suspended from that basin, so the distribution basin carries only its own weight and the weight of the pool of hot water within it. That water flows into the fill from nozzles in the distribution basin and cascades through the multitude of slats in the fill, thereby becoming quite finely divided. Air, on the other hand, passes transversely through the fill and absorbs heat from the water so as to lower the temperature of the water. The framework is composed of a large number of straight sections, each disposed at a slight angle with respect to the next and transitional sections located between the ends of the straight sections, so that the framework has a polygonal configuration. The grids are suspended from both types of sections, so that the fill slats are continuous for the full circumference of the circular cooling section.

10 Claims, 9 Drawing Figures

FIG. 1
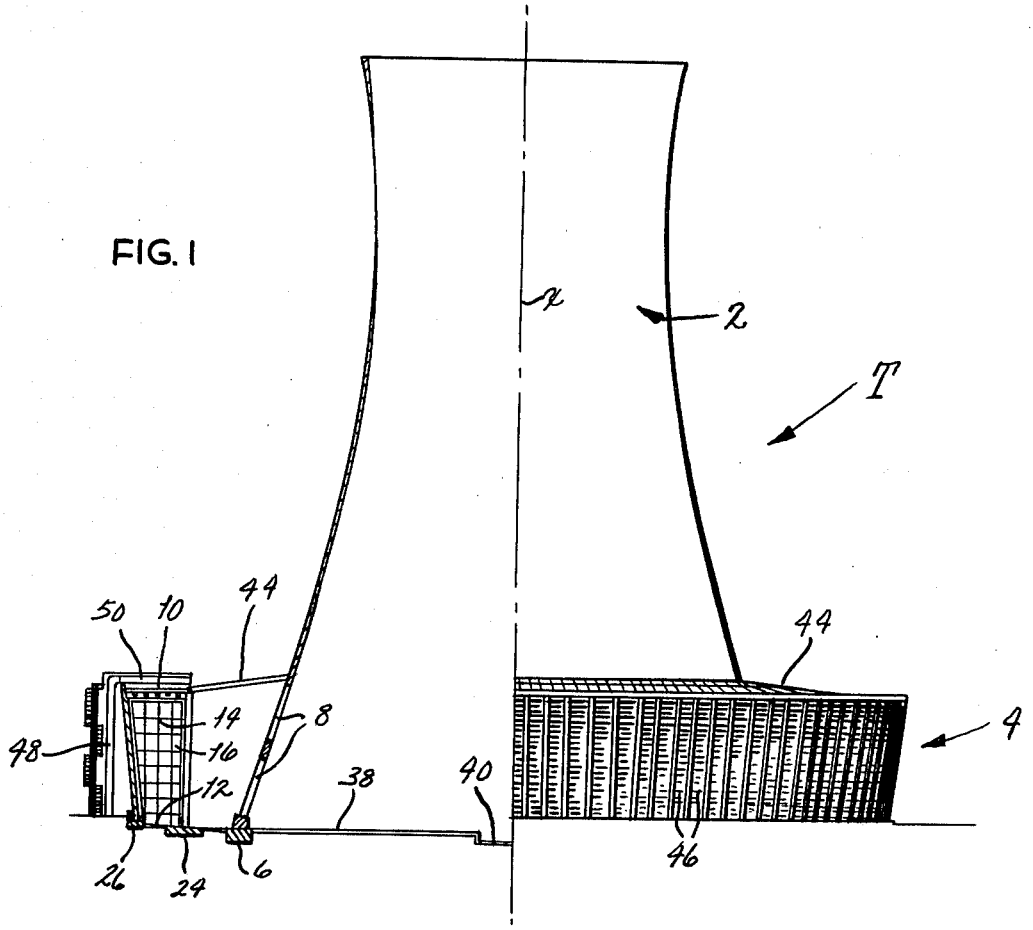
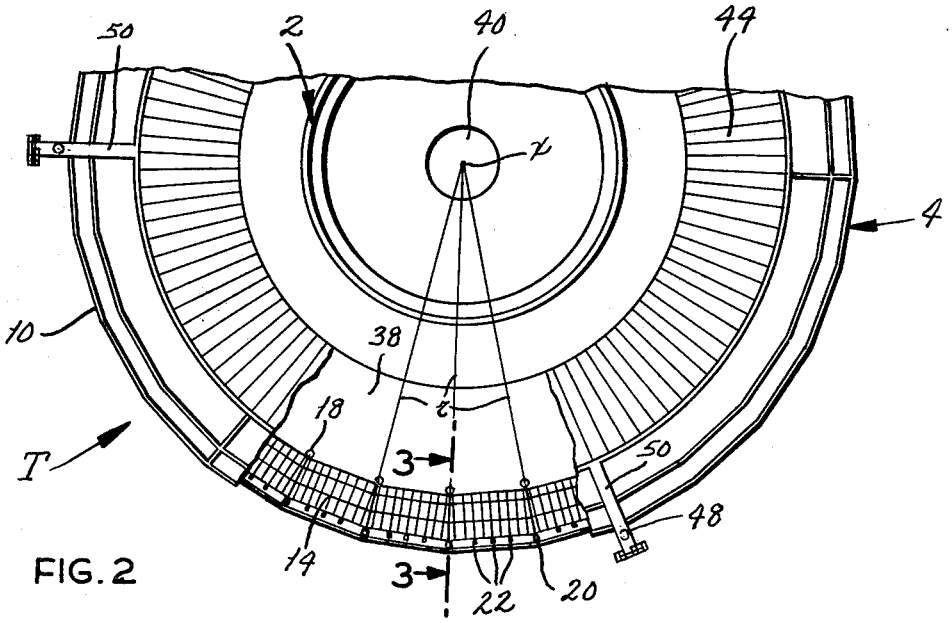
FIG. 2

FIG. 6
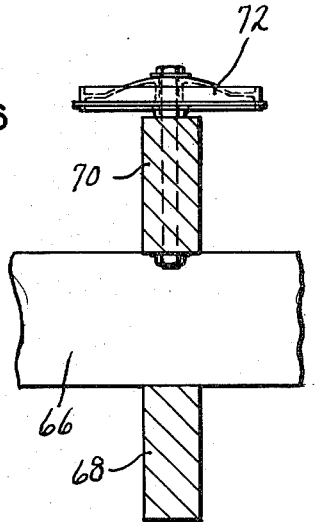
FIG. 8
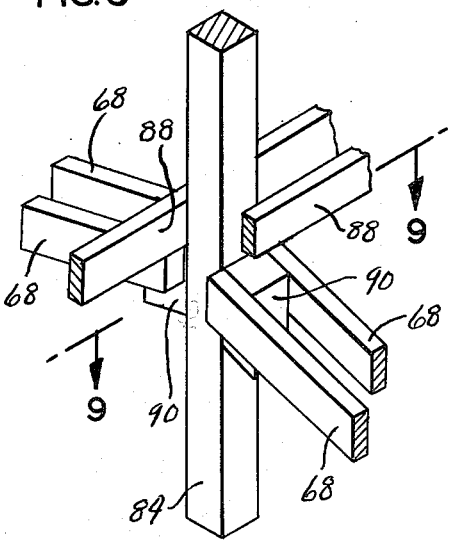
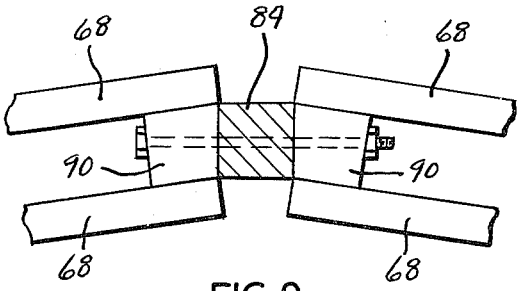
FIG. 9
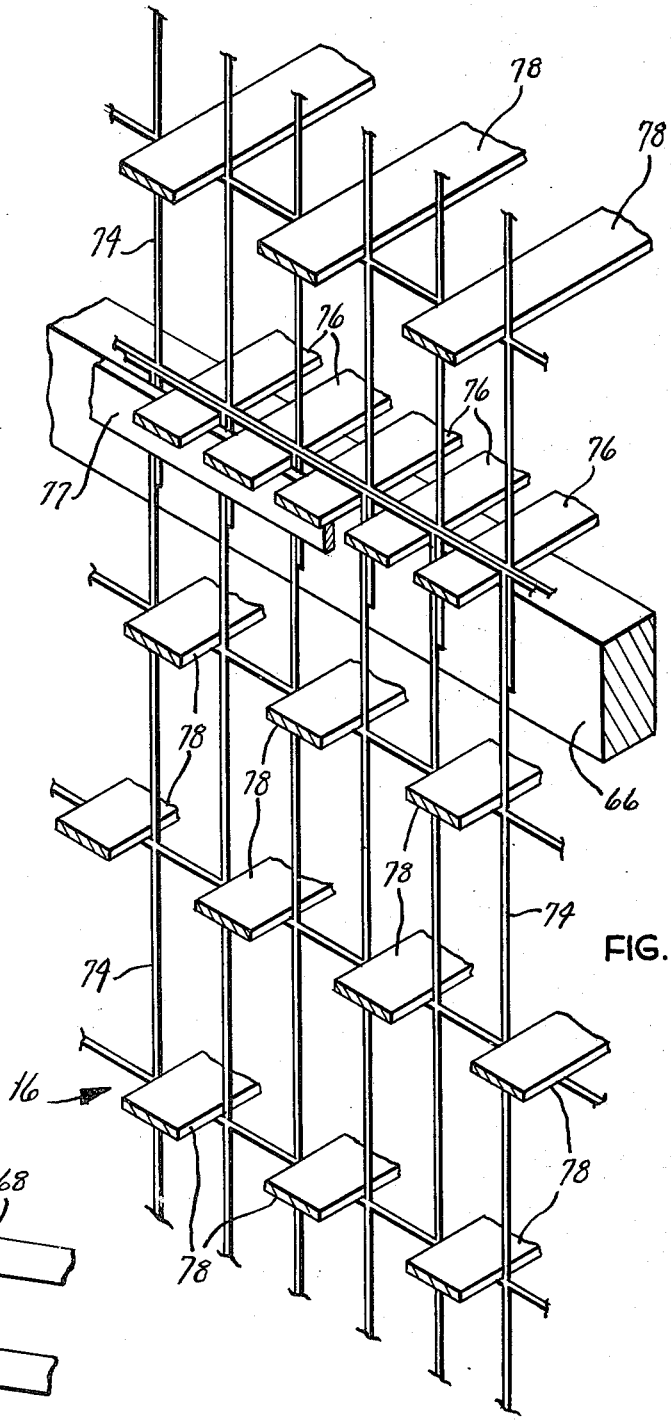
FIG. 7

CIRCULAR COOLING TOWER WITH IMPROVED FILL SUPPORTING STRUCTURE AND PROCESS OF FORMING

BACKGROUND OF THE INVENTION

This invention relates in general to heat exchange equipment and more particularly to cooling towers.

Steam turbine generating equipment accounts for much of the electrical energy produced in the United States, and as any heat engine, a steam turbine cannot convert all of the heat energy that is supplied to it in the form of steam into mechanical energy. Much of the energy which is not converted is lost condensing the low pressure steam that leaves the turbine back into water, and this normally occurs at a water-cooled heat exchanger, more commonly known as a condenser.

Heretofore, it was common practice to locate generating installations adjacent to large bodies of water such as lakes and rivers, for these bodies provide convenient sources of cooling water for the condensers. Indeed, the water was merely pumped out of the lake or river, circulated through the condensers, and then returned to the lake or river at an elevated temperature. Concern for the environment has to a large measure curtailed this practice.

Most generating installations of recent design discharge the waste heat ultimately to the atmosphere instead of to a river or lake, this transfer taking place through intermediate units commonly referred to as cooling towers. The typical cooling tower for a utility plant has a stack that is often over 300 feet high and a circular cooling section that surrounds the base of the stack. The cooling section in turn has a distribution basin located at an elevation of perhaps 50 feet, it being supported on a series of columns. The base of the stack has large openings which open into the region under the distribution basin, and as a consequence, air passes beneath the distribution basin and then rises through the stack to be discharged into the atmosphere at the upper end of the stack. The elevated basin receives hot water from the condensers and discharges this water through a multiplicity of downwardly directed apertures or nozzles. Directly beneath the distribution basin at grade elevation is a collecting basin which collects the water discharged from the nozzles. As the water descends, it passes through the air stream and hence loses some of its heat to the air stream.

To enhance the transfer of heat between the water and air, a multitude of baffles or fill slats are interposed between the two basins such that the water will not flow in well defined streams from the various nozzles, but instead will be dispered into finely divided cascades or splashes. The slats, which are collectively referred to as fill, are nothing more than wood or polymer strips that extend through openings in wire grids and hence are supported on the grids. The grids are spaced relatively close together so that a single slat will pass through several of them, and each grid extends substantially the entire height between the two basins, it normally being suspended from anchors embedded in the underside of the distribution basin.

Conventional cooling towers of the foregoing arrangement proved quite satisfactory at the outset, but in time began to deteriorate, particularly in the northern climates where the water can freeze. In this regard, the weight of the fill is substantial and in time is enough to pull the anchors loose from the bottom of the distribution basin. The formation of ice in the fill compounds the problem, because it increases the weight of the fill significantly. Indeed, at some installations, the weight has been great enough to cause a partial collapse of the distribution basin. In short, cooling towers of current construction are not durable and require constant maintenance, even though they are formed largely from materials, such as concrete, that are considered maintenance free.

Others have supported the fill on wooden frameworks which are in turn supported at the bottoms of the cooling sections, but a framework of this type is complex and expensive to construct. This derives from the fact that it constitutes a multitude of pie-shaped sections in order to accommodate the curvature of the circular cooling section.

SUMMARY OF THE INVENTION

One of the principal objects of the present invention is to provide a cooling tower that is quite durable and requires relatively little maintenance. Another object is to provide a cooling tower of the type stated which is suitable for use in climates where extended temperatures below the freezing point of water are encountered. A further object is to provide a supporting structure for the fill of the tower, with the weight of that structure being carried by the floor of the tower instead of being suspended from the hot water distribution basin, whereby the stresses in the distribution basin of the tower are reduced substantially. An additional object is to provide a fill composed of a multiplicity of straight sections holding straight slats with the straight sections being arranged end-to-end and at slight angles to accommodate the curvature of a circular cooling tower. Still another object is to provide a fill-supporting structure that may easily be substituted for the suspended supporting arrangement of conventional towers. Yet another object is to provide a process for providing a curved cooling tower with an improved fill. These and other objects and advantages will become apparent hereinafter.

DESCRIPTION OF THE DRAWINGS

In the accompanying drawings which form part of the specification and wherein like numerals and letters refer to like parts wherever they occur.

FIG. 1 is an elevational view, partially broken away and in section, of a cooling tower having its fill supported on a framework constructed in accordance with and embodying the present invention;

FIG. 2 is a fragmentary plan view of the cooling tower with its cooling section partially broken away to show the straight primary sections of the fill-supporting framework;

FIG. 6 is a sectional view of the framework taken along line 6—6 of FIG. 4 and showing one of the splash cups;

FIG. 7 is a perspective view of a very small section of the fill and showing the grids and various fill slats;

FIG. 8 is a perspective view of a mast in a transitional section of the framework and showing the longitudinal ties joined thereto; and FIG. 9 is a sectional view taken along line 9—9 of FIG. 8 and showing tie blocks at which the longitudinal ties are connected to the masts of transitional sections.

DETAILED DESCRIPTION

Figure 3:
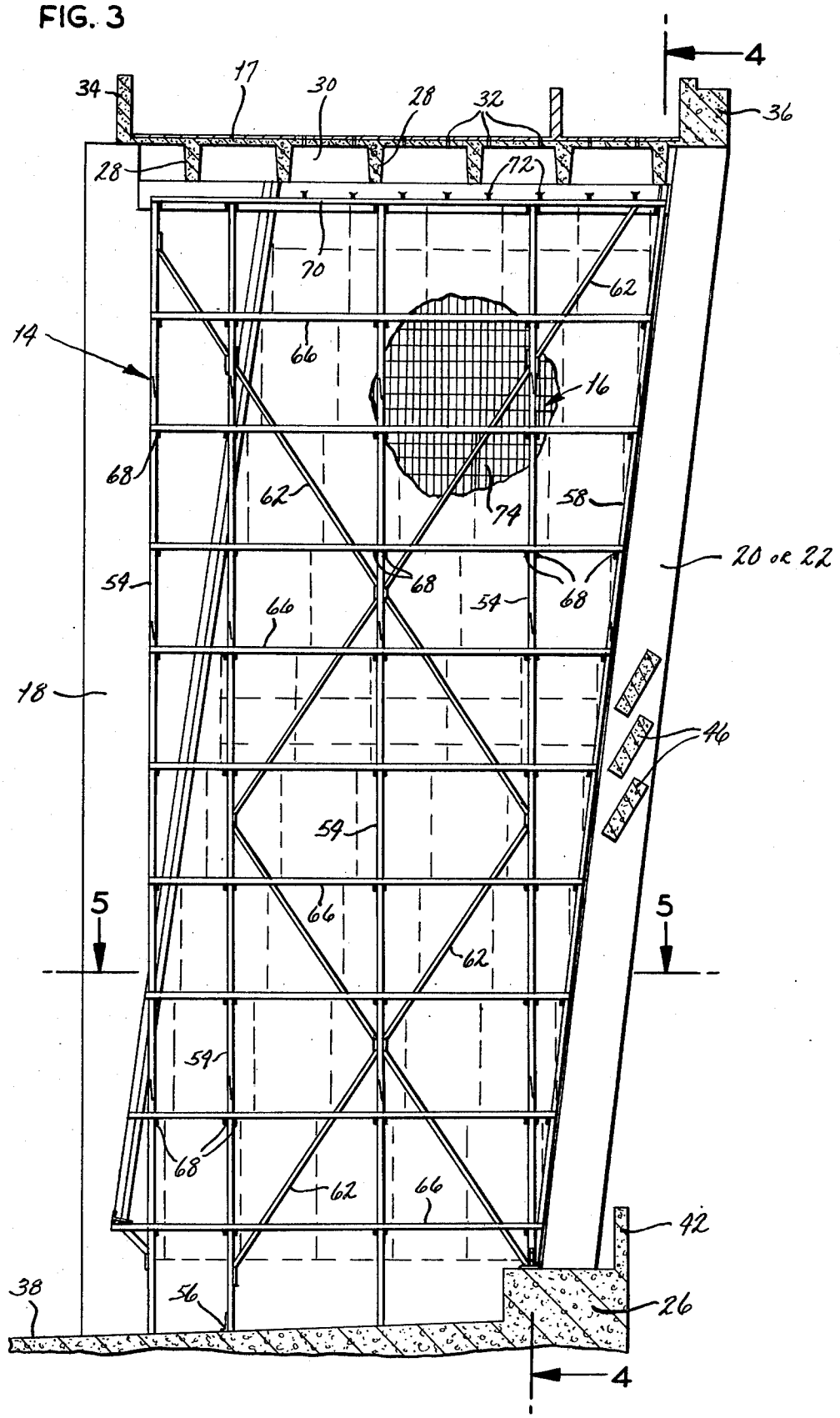
FIG. 3 is a sectional view taken along line 3-3 of FIG. 2 and showing the cooling section of the tower and the fill-supporting framework in that section in elevation.

Referring now to the drawings, a natural draft cooling tower T (FIGS. 1 & 2) includes a stack 2 and a cooling section 4 that surrounds the base of the stack 2, the latter having an annular configuration. In a typical installation the stack 2 rises to an elevation in excess of 300 feet and has a diameter of about 250 feet at its base, whereas the cooling section 4 is over 50 feet high and has a diameter of about 350 feet. The stack 2 functions much like a conventional chimney in that it creates a natural draft which causes air to flow inwardly through the cooling section. Water, which is to be cooled cascades through the cooling section 4 and loses its heat to the air, the air flowing crosswire through that section. The heated air then rises through the stack 2, creating a draft which perpetuates the flow of air through the cooling section 4. The stack 2 and cooling section 4 are symmetrical about a center axis X.

The stack 2 rests on a concrete foundation 6 and projects upwardly considerably beyond the upper surface of the cooling section 4 (FIG. 1). In vertical cross-section its walls have a hyperbolic configuration, the greatest diameter of the wall being at its base and its smallest diameter being somewhat below its upper end. Below the upper end of the cooling section 4 the stack 2 has large openings 8 which permit air to flow into the hollow interior of the stack 2. The stack 2 is preferably formed from poured concrete.

The cooling section 4 basically includes a hot water distribution basin 10 located at the top of the section 4, a cold water collecting basin 12 located at the bottom of the section 4 and also at the base of the stack 2, a framework 14 extended upwardly from the collecting basin 12 to the underside of the distribution basin 10, and a fill 16 supported on the framework 14 (FIG. 1 & 2). Hot water from the condensers of electrical generating equipment is pumped into the distribution basin 12 from which it is discharged into the fill 16 at a multitude of locations. The fill 16 in turn disperses the water into finely divided cascades to effect maximum transfer of heat to the air that flows crosswise through the fill 16 of the cooling section 4.

Figure 5:
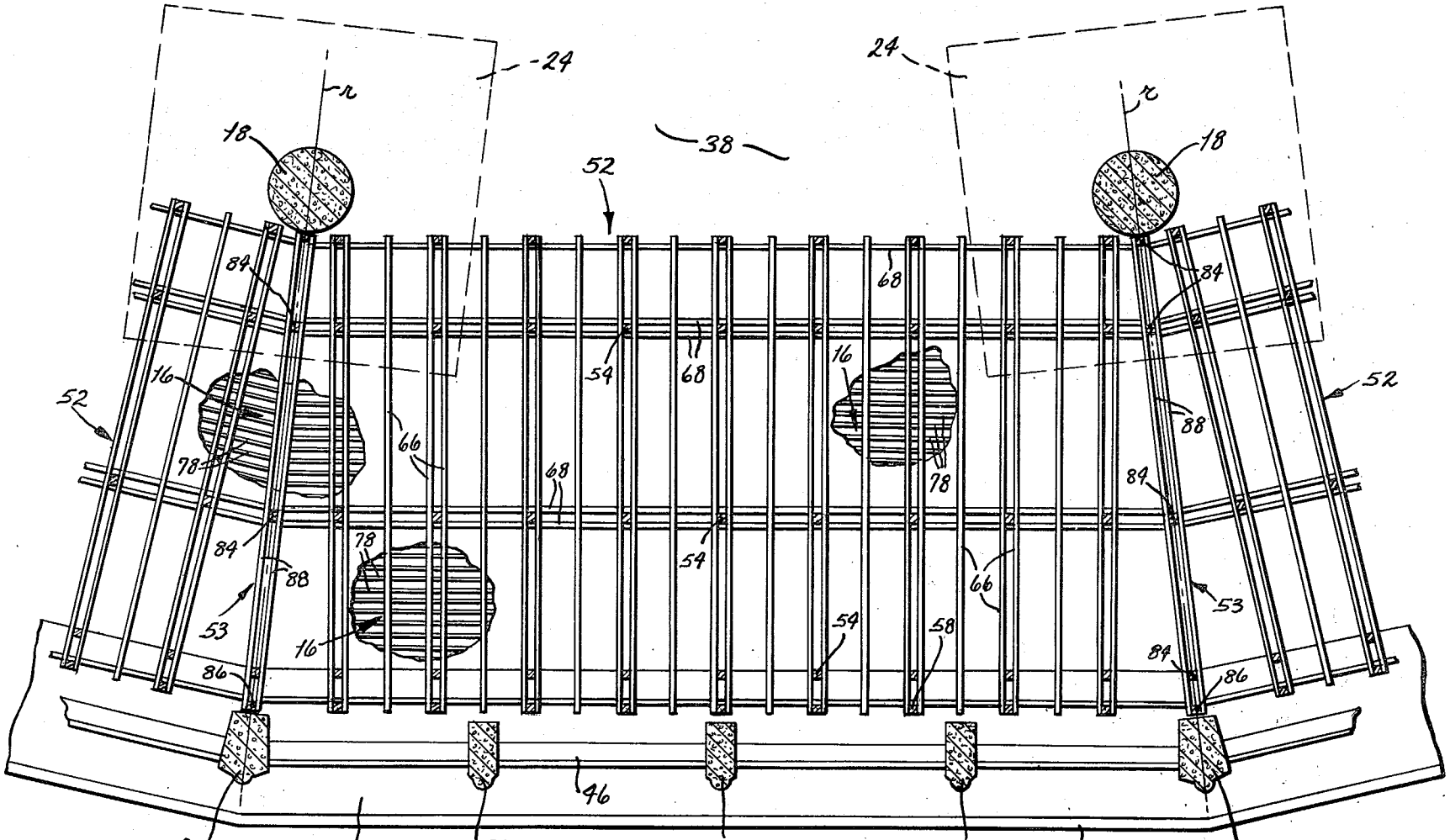
FIG. 5 is a sectional view of the framework taken along line 5—5 of FIG. 3 and showing three primary framework sections separated by transitional sections.

The hot water distribution basin 10 includes a deck 17 of generally circular configuration that is supported over 50 feet above the ground on inner columns 18 and primary and secondary outer columns 20 and 22, respectively (FIGS. 2, 3 & 5). The inner columns 18 in turn rest on inner foundations 24, while the outer columns 20 and 22 rest on a continuous outer or perimeter foundation 26, all of the foundations 24 and 26 being poured concrete. The inner columns 18 are arranged at equal intervals in a circle that is concentric about the axis X, and each extends vertically from the foundations 24 to the deck 17. The primary outer columns 20 are likewise arranged in a circle that is concentric to the axis X, and are further spaced at the same annular intervals as the inner columns 18. Indeed, each primary outer column 20 lies directly outwardly from an inner column 18, that is to say along a single column radius r emanating from the axis X. Instead of extending vertically as do the inner columns 18, the primary outer columns 22 are canted slightly from the vertical such that their lower ends are located closer to the axis X than their upper ends (FIG. 3). The secondary outer columns 22, lie between the primary columns 20, there being three secondary columns 22 between each pair of adjacent primary columns 20. As such the secondary columns 20 within the space between any two adjacent primary columns 22 divide that space into four openings or additional spaces which are equal in width. Moreover, the three secondary columns 22 between any adjacent pair of primary columns 20 do not lie along the circle formed by the primary columns 20, but instead lie along a straight line that intersects the adjacent primary columns 20. The secondary columns 22, like the primary columns 20, are tilted outwardly so that they are inclined at the same angle as the primary columns 20, but they are of smaller cross-sectional area than the primary columns 20. All three types of columns 18, 20 and 22 are preferably cast from poured concrete.

Figure 4:
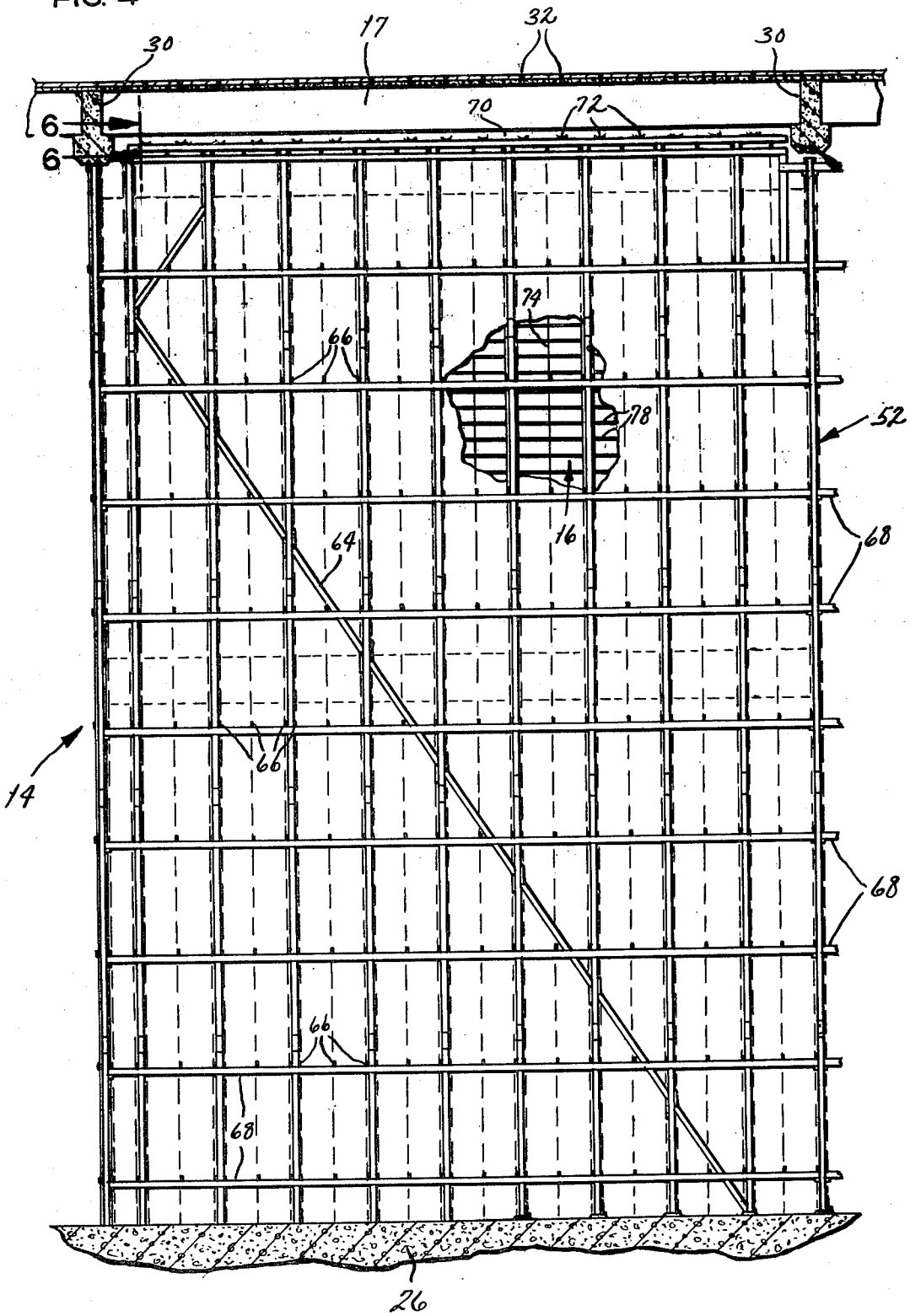
FIG. 4 is an elevational view of a small segment of the framework taken along line 4—4 of FIG. 3.

The deck 17 of the distribution basin 10 is also cast preferably from poured concrete, and is supported on underlying circumferential beams 28 (FIG. 3) and radial beams 30 (FIG. 4). The radial beams 30 extend radially with respect to the center axis X and are positioned such that they rest on top of the inner columns 18 and the primary outer columns 20, spanning the spaces between those columns. The circumferential beams 28 are parallel to each other and extend between the radial beams 26. However, they are not arcuate, but instead straight with each beam 28 being parallel to the line defined by the three secondary outer columns 22 located directly outwardly from it. In the spaces between the beams 26 and 28 the deck 17 has apertures or nozzles 32 (FIGS. 3 & 4) which extend completely through the deck 17 and open downwardly toward the framework 14 and the fill 16 supported on it.

The inner margin of the deck 16 is circular and is located over the inner columns 18, while the outer margin is slightly polygonal, it being formed by a series of straight segments that extend between adjacent primary columns 20. As such each segment of the outer margin is parallel to the line defined by the two primary columns 20 and the three secondary columns 22 that are beneath it.

In addition to the deck 17 and the beams 28 and 30, the hot water distribution basin 10 includes an inner curb 34 and an outer curb 36 (FIG. 3). The inner curb 34 lies along the inner margin of the deck 17 and is circular. The outer curb 36 lies along the outer margin and is slightly polygonal. Thus, the curbs 30 and 32 follow the contours of the margins along which they lie. Moreover, each is sealed to the deck 17 so that a pool of water may be trapped between the two curbs 30 and 32. As such, the nozzles 32 in the deck 17 constitute the only drain for the pool.

The cold water collecting basin 12 includes a poured concrete floor 38 (FIGS. 1-3) that extends inwardly from the perimeter foundation 26 on which the outer columns 20 and 22 rest to the center of the stack 2 where it is provided with a sump 40 from which the cold water is withdrawn and returned to the condensers. The floor 38 slopes slightly downwardly from the outer foundation 26 and in so doing passes over the inner foundation 24 and the foundation 6 for the stack 2. Along the periphery of the perimeter foundation 26 is another curb 42.

The space between the inner curb 34 of the deck 17 and the outer surface of the stack 2 is closed by a canopy 44 (FIGS. 1 & 2) that slopes downwardly toward the deck 17. The canopy 44 prevents the cooling air that passes through the cooling section 4 from rising along the inner margin of the deck 16, and thus directs the air into the interior of the stack 2 so that it will rise through the hollow interior of the stack 2.

In addition to supporting the deck 17, the outer columns 20 and 22 also support louvers 46 which in effect obstruct the spaces between adjacent columns 20 and 22 to the extent that high winds will be damped without impeding the natural flow of air through the cooling section 4. The louvers 46 may be cast concrete panels.

At three equally spaced locations around the cooling section 4 of the tower T, risers 48 (FIGS. 1 & 2) extend upwardly from grade elevation. The risers 48 at their lower ends are connected by other piping to the hot water outlets for the condensers, and at their upper ends they open into distribution boxes 50 that extend radially inwardly over the deck 16. The hot water flows from the boxes 50 into the hot water distribution basin 10.

With the exception of the framework 14 and the manner in which the fill 16 is supported on it, the foregoing components of the cooling tower T are conventional and are found in quite a few cooling towers of current construction. Indeed, the framework 14 may be used in existing cooling towers as a replacement for the current arrangement of suspending fill hangers from the elevated distribution basin 10. In lieu of suspending the entire fill 16 from the basin 10, the fill 16 is instead supported on the framework 14 which rests on the outer foundation 26 as well as on the floor 38 of the cold water collecting basin 12 and is of essentially polygonal configuration. The only weight supported by the basin 10 is that of the pool of water that is maintained in the basin 10 by constant replenishment from the risers 48.

The fill supporting framework 14 extends through and around the entire cooling section 4 (FIG. 2), and is polygonal in configuration, it being composed of a number of straight primary sections 52 arranged end-to-end (FIG. 5) and secondary transitional sections 53 between the ends of the primary sections 52. The straight primary sections 52 lie between the column radii r, there being a single primary section 52 between each pair of adjacent radii 4, whereas the transitional sections 53 lie along the column radii r, there being a single section 53 along each radii r. The inner and outer sides of the primary sections 52 are straight and this imparts a polygonal configuration to the entire framework 14.

Each primary section 52 is longer than it is wide, and its straight inner and outer sides lie parallel to each other and to the portion of the outer basin curbs 36 and 42 for that portion of the cooling section 4 in which the framework section 52 is disposed. The shorter sides of the primary section 52 are along the two column radii r between which the section 52 lies.

Each primary section 52 consists of a multitude of vertical masts 54 (FIGS. 3–5) that are arranged in straight transverse and longitudinal rows, with the longitudinal rows being parallel to the adjacent basin curbs 36 and 42 and the transverse rows being perpendicular to those curbs 36 and 42. The transverse rows are much closer together than the longitudinal rows, and this, coupled with the fact that the primary section 52 is somewhat longer than it is wide, results in considerably more transverse rows than longitudinal rows. The masts 54 rest either on the basin floor 38 or the perimeter foundation 26 and some are secured by angle brackets 56 that are anchored to the concrete of the floor 38 or foundation 26 (FIG. 3). In addition to the vertical masts 54, the primary section 52 also includes a row of inclined masts 58 along its outwardly presented side. The masts 58 of the outer row rest on the perimeter foundation 26 adjacent to the outermost vertical masts 54 and extend upwardly therefrom parallel to the secondary columns 22. Indeed, the inclined masts 58 are located only a few inches from the plane defined by the inside faces of the columns 22. To further rigidify the primary section 52, it is provided with diagonal bracing 62 (FIG. 3) that lies in the planes of the transverse rows, and more diagonal bracing 64 (FIG. 4) that lies in the planes of the longitudinal rows.

Aside from the masts 54 and 58 and the bracing 62 and 64, the primary section 52 has cross ties 66 and longitudinal ties 68 (FIGS. 3–5). Most of the former extend along the transverse rows of masts 54 and 58 in pairs, with the two cross ties 66 of each pair being on opposite sides of the masts 54 and 58 along which they lie. The cross ties 66 extend horizontally and are arranged in several levels with the spacing between the levels being generally equal. The longitudinal ties 68 extend horizontally along the longitudinal rows of the vertical masts 54 and the inclined masts 58, and as to all of the vertical masts 54 except the ones of the innermost longitudinal row, they are arranged in pairs, the two longitudinal ties 68 of each pair being on opposite sides of their respective masts 54. As to the inclined masts 58 and the vertical masts 54 of the innermost row, only a single longitudinal tie 68 extends along the rows formed by those masts. Moreover, the longitudinal ties 68 are arranged in levels that correspond to the levels of the cross ties 66. Actually, the longitudinal ties 68 of any level tie directly beneath the cross ties 66 of that level, so that levels are well defined. Between the transverse rows of masts 54 and 58, the longitudinal ties support additional or intermediate cross ties 66 (FIG. 4).

The vertical masts 54, the inclined masts 58 and the bracing 62 and 64 are all preferably 4×4 lumber, whereas the cross ties 66 and longitudinal ties 68 are preferably 2×4 lumber. In any event, all of the lumber is pressure treated with a preservative, and as such is extremely durable.

Extended over the cross ties 66 of the uppermost level are splash cup supports 70 (FIGS. 3 & 4), which may also be pressure treated 2×4 lumber. The supports 70 run parallel to the longitudinal ties 68, but in contrast to the ties 68 are positioned directly beneath the nozzles 32 in the overlying deck 16. In this regard, the nozzles 32 are arranged in rows which are parallel to the outer curb 36 of the elevated distribution basin 10. The splash cup supports 70 in turn carry metal or plastic splash cups 72 (FIG. 6) which are aligned with the various nozzles 32 so that the water passing through any one of the nozzles 32 will impinge against a splash cup 72 before coming against any of the wood portions of the framework 14. Each splash cup 72 deflects the stream of water that is directed against it from the overlying nozzle 32 horizontally in 360°, or in other words, disperses the stream.

At each cross tie 66 or pair of cross ties 66, the primary section 52 supports a metal grid 74 (FIG. 7) that is high enough to extend from one level of cross ties 66 to the next lower level of cross ties 66. The grid 74 is formed from a wire mesh that is preferably coated with a polymer to prevent it from oxidizing, and the openings in this mesh are preferably 6 inches high and 2 inches wide. As such they exceed the height of the cross ties 66 past which they extend. The grids 74 are supported on the cross ties 66 by fill slats 76 which form part of the fill 16. Each fill slat 76 extends over several cross ties 66 and through an uppermost opening in the several grids 74 that it supports. Indeed, each opening in the uppermost row of openings for every grid 74 is occupied by a fill slat 76, so every grid 74 is supported along its entire top wire and therefore hangs without buckling or otherwise distorting. Moreover, each grid 74 extends from only one level to the next lower level, and at that lower level its vertical wires project downwardly between the fill slats 76 of the lower level. This further stabilizes the grids 74 and maintains them correctly positioned. The grids 74 are secured against the cross ties 66 on which they are supported by stabilizer slats 77 which extend over the grids 74 immediately beneath the supporting fill slats 76 and are nailed against the sides of the cross ties 66. Since the grids 74 are quite short and are supported at the various levels of cross ties 66, the weight of the fill 14 is distributed generally uniformly throughout the entire primary section 52 of the framework 14.

Aside from the fill slats 76 that actually support the grids 74, the fill 16 also includes more fill slats 78 (FIG. 7) that extend through the grids 74 in the regions between the various levels of the framework 50. In contrast to the supporting fill slats 76, these additional fill slats 78 do not occupy every opening in the horizontal grid rows, but instead may occupy every other opening, so that alternate openings are left empty. Hence, the additional fill slats 78 for any horizontal row or level are spaced further apart than the supporting fill slats 76. Moreover, the grid openings that are occupied by the additional fill slats 78 alternate in the vertical rows of openings as well. Thus, if an opening along one horizontal row or level in a grid 74 is occupied by a fill slat 78, the opening immediately below it in the next lower row will be empty and vice-versa. Other patterns with larger horizontal intervals for the fill slats 78 are also possible.

The fill slat 76 and 78 are preferably relatively thin lumber, perhaps $\frac{3}{8}''$ by $1\frac{1}{2}''$. This lumber should be pressure treated with a preservative to withstand the moisture to which it is subjected. In the alternative, the slats 76 and 78 may be formed from a polymer, but polymer slats 76 and 78 are not nearly as durable as wooden slats 76 and 78 under icing conditions.

The fill slats 76 and 78 break up the water that is deflected from the splash cups 72, into more or less individual drops so that the water cascades through the fill 16 with maximum exposure to the air that flows transversely through the fill 16 toward the interior of the stack 2. This enhances evaporation of the water which in turn extracts a large amount of heat from the water.

The secondary transitional sections 53 of the framework 14, which sections are located between the adjacent primary sections 52 (FIG. 5), serve to tie the much larger primary sections 52 together so that the framework 14 is continuous and polygonal in configuration. Each transitional section 53 lies between a pair of inner support columns 18 and primary outer columns 20 and along the column radius r that extends through those columns 18 and 20. It includes vertical masts 84 that extend upwardly from the perimeter foundation 26 and basin floor 38 and an inclined mast 86 that extends upwardly from the foundation 26 adjacent to the primary outer column 20. Indeed, the inclined mast 86 is located close to and is parallel to the outer column 20. The masts 84 and 86 are connected together by cross ties 88, which are arranged at levels corresponding to the levels of the cross ties 66 in the primary sections 52. Moreover, the masts 84 and 86 align with and lie along the longitudinal rows of masts 54 and 58 from the primary sections 52 on each side of the section 82. In fact, the masts 84 and 86 lie at the points where corresponding longitudinal rows of the adjacent primary sections 52 will intersect if extended. Indeed, the longitudinal ties 68 from both of the adjacent primary sections 52 are extended and connected with the masts 84 and 86 of the intermediate sections, immediately below the cross ties 88 on those sections. However, instead of being bolted directly against the masts 84 and 86, the longitudinal ties 68 are bolted to tie blocks 90 (FIG. 8) which in turn are secured to the masts 84 and 86. The tie blocks 90 compensate for the oblique disposition of the masts 84 and 86 with respect to the longitudinal ties 68. To this end, one face of each block 90 is cut on a bevel and it is along this face that the block 90 is bolted its mast 84 or 86 (FIG. 9). The bevel is such that the sides of the block 90 are parallel with the longitudinal ties 68 that are extended toward it from the adjacent primary section 52, and indeed those longitudinal ties 68 are bolted against the sides of the tie block 90.

Extended over the cross ties 80 of each intermediate section 82 are more supporting fill slats 76 that rest not only on the cross ties 88 of the intermediate section 82, but also on the endmost cross ties 66 of the adjacent primary sections 52. The supporting fill slats 76 support more grids 74 which extend to the next lower levels and carry additional fill slats 78 (FIG. 5) in the alternating arrangement previously described.

Thus the cooling section 4 contains fill slats 76 and 78 for the full circumference of the cooling section 4 of the tower T.

In lieu of operating on the natural draft principle, which is made possible by the stack 2, the cooling tower may utilize forced draft to bring air through the cooling section 4. In that case, the stack 2 is not required, and large fans are substituted for it.

This invention is intended to cover all changes and modifications of the example of the invention herein chosen for purposes of the disclosure which do not consitute departures from the spirit and scope of the invention.

What is claimed is:

1. A process for providing a circular cooling tower with a fill that is capable of dispersing water that passes through it, the cooling tower having a center axis and including a circular collecting basin formed from concrete with its center along the axis, inner and outer columns arranged in concentric inner and outer rows, respectively, along the collecting basin with the common center of the two circular rows being along the center axis, the inner columns corresponding in number to the outer columns and each outer column, with respect to the center axis, being located directly outwardly from an inner column such that the inner and outer columns are arranged in pairs with each pair being along a different radius emanating from the center axis, a concrete distribution basin supported on the columns directly above the collecting basin and being of generally annular configuration with its center along the center axis, the distribution basin being configured to contain an elevated pool of water and having nozzles which enable water to flow under the influence of gravity from the elevated pool toward the collecting basin, and means for causing air to flow generally radially through the space between the collecting and distribution basins, said process comprising: erecting on the collecting basin a framework that is, in terms of support, independent of the columns and distribution basin and extends upwardly from the collecting basin to generally occupy the space between the two basins, the framework including a plurality of masts extending upwardly from the collecting basin and arranged in straight and parallel longitudinal rows between adjacent pairs of columns, the masts between adjacent pairs of columns also being arranged in parallel transverse rows except for the masts at the ends of the longitudinal rows which lie along the radii defined by such columns, longitudinal ties extended horizontally along the longitudinal rows and being fastened to the masts with the longitudinal ties between any adjacent pairs of columns being straight and parallel and oblique to the longitudinal ties located beyond those pairs of columns, cross ties extended along the transverse rows of masts and likewise being fastened to the masts with the cross ties between the radii formed by any adjacent pairs of columns being parallel and oblique to the cross ties located at or immediately beyond those pairs of columns; hanging grids from the framework such that they are presented vertically throughout the framework; and extending fill slats through the grids such that the fill slats are supported by the grids and are positioned in the path of the water as it flows from the distribution basin to the collecting basins, whereby the water is dispersed.

2. In combination with a circular cooling tower having a center axis and including a circular collecting basin formed from concrete with its center along the axis, inner and outer columns arranged in concentric inner and outer rows, respectively, along the collecting basin with the common center of the two circular rows being along the center axis, the inner columns corresponding in number to the outer columns and each outer column, with respect to the center axis, being located directly outwardly from an inner column such that the inner and outer columns are arranged in pairs with each pair being along a different radius emanating from the center axis, a concrete distribution basin supported on the columns directly above the collecting basin and being of generally annular configuration with its center along the center axis, the distribution basin being configured to contain an elevated pool of water and having nozzles which enable water to flow under the influence of gravity from the elevated pool toward the collecting basin, and means for causing air to flow generally radially through the space between the collecting and distribution basins, the improvement comprising: a framework supported on the collecting basin independently of the columns and distribution basin and extending upwardly from the collecting basin to generally occupy the space between the two basins, the framework including a plurality of masts extending upwardly from the collecting basin and arranged in straight and parallel longitudinal rows between adjacent pairs of columns, the masts between adjacent pairs of columns also being arranged in parallel transverse rows except for the masts at the ends of the longitudinal rows which lie along the radii defined by such columns, longitudinal ties extended horizontally along the longitudinal rows and being fastened to the masts with the longitudinal ties between any adjacent pairs of columns being straight and parallel and oblique to the longitudinal ties located beyond those pairs of columns, cross ties extended along the transverse rows of masts and likewise being fastened to the masts with the cross ties between the radii formed by any adjacent pairs of columns being parallel and oblique to the cross ties located at or immediately beyond those pairs of columns; grids supported vertically on the framework throughout the framework; and fill slats extended through and supported on the grids such that the fill slats are positioned in the path of the water as it flows from the distribution basin to the collecting basins, whereby the water is dispersed.

3. The combination according to claim 2 wherein the cross ties which extend along and are fastened to the masts that are between inner and outer columns of a pair of such columns are parallel to the radii defined by those columns and are oblique to cross ties that extend along the parallel transverse rows on each side of them.

4. The combination according to claim 2 wherein the grids are located along the cross ties and lie in vertical planes parallel to such cross ties, and the fill slats are parallel to the longitudinal ties.

5. In combination with a circular cooling tower having a center axis and including a circular collecting basin formed from concrete with its center along the axis, inner and outer columns arranged in concentric inner and outer rows, respectively, along the collecting basin with the common center of the two circular rows being along the center axis, the inner columns corresponding in number to the outer columns and each outer column, with respect to the center axis, being located directly outwardly from an inner column such that the inner and outer columns are arranged in pairs with each pair being along a different radius emanating from the center axis, a concrete distribution basin supported on the columns directly above the collecting basin and being of generally annular configuration with its center along the center axis, the distribution basin being configured to contain an elevated pool of water and having nozzles which enable water to flow under the influence of gravity from the elevated pool toward the collecting basin, and means for causing the air to flow generally radially through the space between the collecting and distribution basins, the improvement comprising: a framework supported on the collecting basin independently of the columns and distribution basin and extending upwardly from the collecting basin to generally occupy the space between the two basins, the framework including a plurality of primary sections arranged end-to-end in a circle with each primary section being straight and at a slight angle, with respect to the primary section that is adjacent to it, and transitional sections interposed between the ends of the primary sections, each primary section occupying the space between two adjacent pairs of inner and outer columns and including masts that extend upwardly from the collecting basin, straight longitudinal ties extended horizontally generally in the circumferential direction, and straight cross ties likewise extended horizontally but perpendicular to the longitudinal ties, the masts, the longitudinal ties and the cross ties all being joined together so that the primary section which they constitute is rigid, each transitional section including masts extending upwardly from the collecting basin between the inner and outer columns of a pair of such columns and horizontal cross ties that are parallel to the radius along which those inner and outer columns lie; grids supported vertically on the framework throughout the framework; and fill slats extended through and supported on the grids such that the fill slats are positioned in the path of the water as it flows from the distribution basin to the collecting basins, whereby the water is dispersed.

6. The combination according to claim 5 wherein the longitudinal ties of each primary section, at the ends of such primary section, extend to and connect with the transitional sections at those ends generally at the radii along which the pairs of inner and outer columns at its ends lie.

7. The combination according to claim 6 wherein the longitudinal ties of adjacent primary sections are at oblique angles with respect to each other.

8. The combination according to claim 5 wherein the grids lie in planes parallel to the cross ties and the fill slats extend parallel to the longitudinal ties.

9. The combination according to claim 5 wherein the masts of the transitional sections of the framework lie along the radii defined by the pairs of inner and outer columns.

10. The combination according to claim 5 wherein the longitudinal ties of the primary sections of the framework extend along and are fastened to the masts of the primary section; and wherein the masts of the transitional sections have beveled blocks fastened to them and the longitudinal ties are also attached to the beveled blocks.

* * * * *